US007303142B2

(12) United States Patent
Gluck

(10) Patent No.: US 7,303,142 B2
(45) Date of Patent: Dec. 4, 2007

(54) NOVELTY WATERFALL OPERATABLE BASED UPON USER INTERACTION

(76) Inventor: J. Robert Gluck, 7 Sealy Dr., Lawrence, NY (US) 11559

( * ) Notice: Subject to any disclaimer, the term of this patent is extended or adjusted under 35 U.S.C. 154(b) by 40 days.

(21) Appl. No.: 10/991,417

(22) Filed: Nov. 19, 2004

(65) Prior Publication Data

US 2006/0108437 A1 May 25, 2006

(51) Int. Cl.
*B05B 17/04* (2006.01)

(52) U.S. Cl. ..... 239/12; 239/16; 239/17; 239/67; 239/69; 239/289; 40/406

(58) Field of Classification Search ..... 239/16–23, 239/67, 69, 289, 12; 307/116, 119; 401/131; 40/406, 407; 428/13; 472/128; D23/201
See application file for complete search history.

(56) References Cited

U.S. PATENT DOCUMENTS 4,107,484 A * 8/1978 Petersen, III ..... 200/43.04
4,213,197 A * 7/1980 Magori ..... 367/94
4,359,615 A * 11/1982 Meyerhoefer et al. ... 200/43.07
4,604,735 A * 8/1986 Parsons ..... 367/93
4,817,312 A * 4/1989 Fuller et al. ..... 239/12
4,839,533 A * 6/1989 Aga ..... 307/140
5,069,387 A * 12/1991 Alba ..... 239/18
5,637,361 A * 6/1997 Scheurich ..... 428/13
5,796,355 A * 8/1998 Smigelski ..... 341/33
5,853,130 A * 12/1998 Ellsworth ..... 239/548
6,055,934 A * 5/2000 Burns et al. ..... 239/23
6,149,070 A * 11/2000 Hones ..... 239/17
D437,383 S * 2/2001 Sater et al. ..... D23/201
D437,628 S * 2/2001 Sater et al. ..... D23/201
D437,629 S * 2/2001 Sater et al. ..... D23/201
6,268,574 B1 * 7/2001 Edens ..... 200/43.04
6,276,612 B1 * 8/2001 Hall ..... 239/17
6,427,927 B1 * 8/2002 Hall ..... 239/17
6,611,114 B1 * 8/2003 Yen ..... 315/360
6,652,348 B2 * 11/2003 Yen ..... 446/158
D491,250 S * 6/2004 Raymond et al. ..... D23/201
6,755,349 B2 * 6/2004 Beidokhti ..... 239/17

* cited by examiner

*Primary Examiner*—Steven J. Ganey
(74) *Attorney, Agent, or Firm*—Greenblum & Bernstein, P.L.C.

(57) ABSTRACT

A novelty waterfall that includes at least one water flow surface, a pump, and a sensor that detects a change of presence of an item. The novelty waterfall further includes a controller that is structured and arranged to operate the pump at least when the sensor detects the change of presence of the item. The instant abstract is neither intended to define the invention disclosed in this specification nor intended to limit the scope of the invention in any way.

22 Claims, 5 Drawing Sheets

NOVELTY WATERFALL OPERATABLE BASED UPON USER INTERACTION

BACKGROUND OF THE INVENTION

1. Field of the Invention

The present invention relates to a novelty waterfall having an operative feature that operates the waterfall based upon user interaction with the waterfall. More specifically, the novelty waterfall can include an additional feature, such as a pen holder.

2. Discussion of Background Information

It is known to have a novelty waterfall that is configured to have water flow across a surface, a series of rocks, or down a vertical face. Such a waterfall creates a soothing sound, visual effect, and/or environment. However, a typical conventional novelty waterfall does not have any additional functionality other than the water falling when the waterfall is powered and moreover a conventional novelty waterfall will merely operate continuously when operatively powered.

SUMMARY OF THE INVENTION

The present invention is directed to a novelty waterfall that includes a sensor that can determine when a user is interacting with the waterfall. In response to the interaction with the waterfall, the waterfall will be activated.

The operative feature is, in one aspect, associated with the pen holder. Thus, the novelty waterfall can sense when a user interacts with the waterfall by interaction with a pen in the pen holder. The novelty waterfall subsequently operating in response to the user interaction.

One aspect of the present invention includes a novelty waterfall that includes at least one water flow surface, a pump, and a sensor that detects a change of presence of an item. The novelty waterfall further includes a controller that is structured and arranged to operate the pump at least when the sensor detects the change of presence of the item.

In a further aspect of the present invention, the sensor can be a first switch and the first switch is one of opened or closed to detect the change of presence of the item. The novelty waterfall can further include a pen holder, and the first switch can be in the pen holder and the change of presence of the item is detected when the first switch is one of opened or closed when a user one of removes or places a pen in the pen holder. Moreover, the novelty waterfall can include a water outlet, a conduit that is configured to allow water to flow to the top of the waterfall and out of the water outlet, a motor associated with the pump that pumps water through the conduit, and a water inlet that allows water to enter from the at least one surface to provide water to the pump. Furthermore, the novelty waterfall can include a second switch, and when the second switch is in a first position, the waterfall operates when the sensor detects the change of presence of the item. Moreover, when the second switch is in a second position the waterfall may not operate. Additionally, the second switch can include a third position and when the second switch is in the third position, the waterfall can operate continuously. Furthermore, the controller can be structured and arranged to connect the pump and motor to a power source. Moreover, the controller can cause water to flow across the at least one surface for a predetermined time after the sensor detects the change of presence. Additionally, the controller can include an electrical circuit and a business card holder.

Yet another aspect of the present invention includes a novelty waterfall that includes at least one water flow surface, a water outlet, a conduit configured so that water flows up to and out of the water outlet, a pump and motor that pumps water through the conduit. Moreover, the novelty waterfall includes a water inlet that allows water to enter from the at least one surface to provide water to the pump, a controller structured and arranged to operate the pump and motor when there is user interaction, and a pen holder in which a first switch is located in the pen holder and user interaction is sensed when the first switch is one of opened or closed when a user one of removes or places a pen in the pen holder.

A further aspect of the novelty waterfall can include a second switch in which when the second switch is in a first position, the waterfall operates when the sensor senses user interaction, and when the second switch is in a second position the waterfall does not operate. Moreover, the second switch can include a third position and when the second switch is in the third position, the waterfall operates continuously. Additionally, the controller can be structured and arranged to connect the pump and motor to a power source. Furthermore, the controller can cause water to flow across the at least one surface for a predetermined time after the sensor senses user interaction. Moreover, the controller can include an electrical circuit and can include a business card holder.

Another aspect of the present invention includes a method of operating a novelty waterfall that includes one of removing an item from or placing an item into a receptacle coupled to the novelty waterfall, and operating the novelty waterfall for a predetermined time in response to one of removing or placing the item.

A further aspect of the method can further include sensing when a first switch is one of opened or closed when a user removes or places the item into the receptacle, and the item is a pen and the receptacle is a pen holder. Moreover, a novelty waterfall can operate according to the above-noted method.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
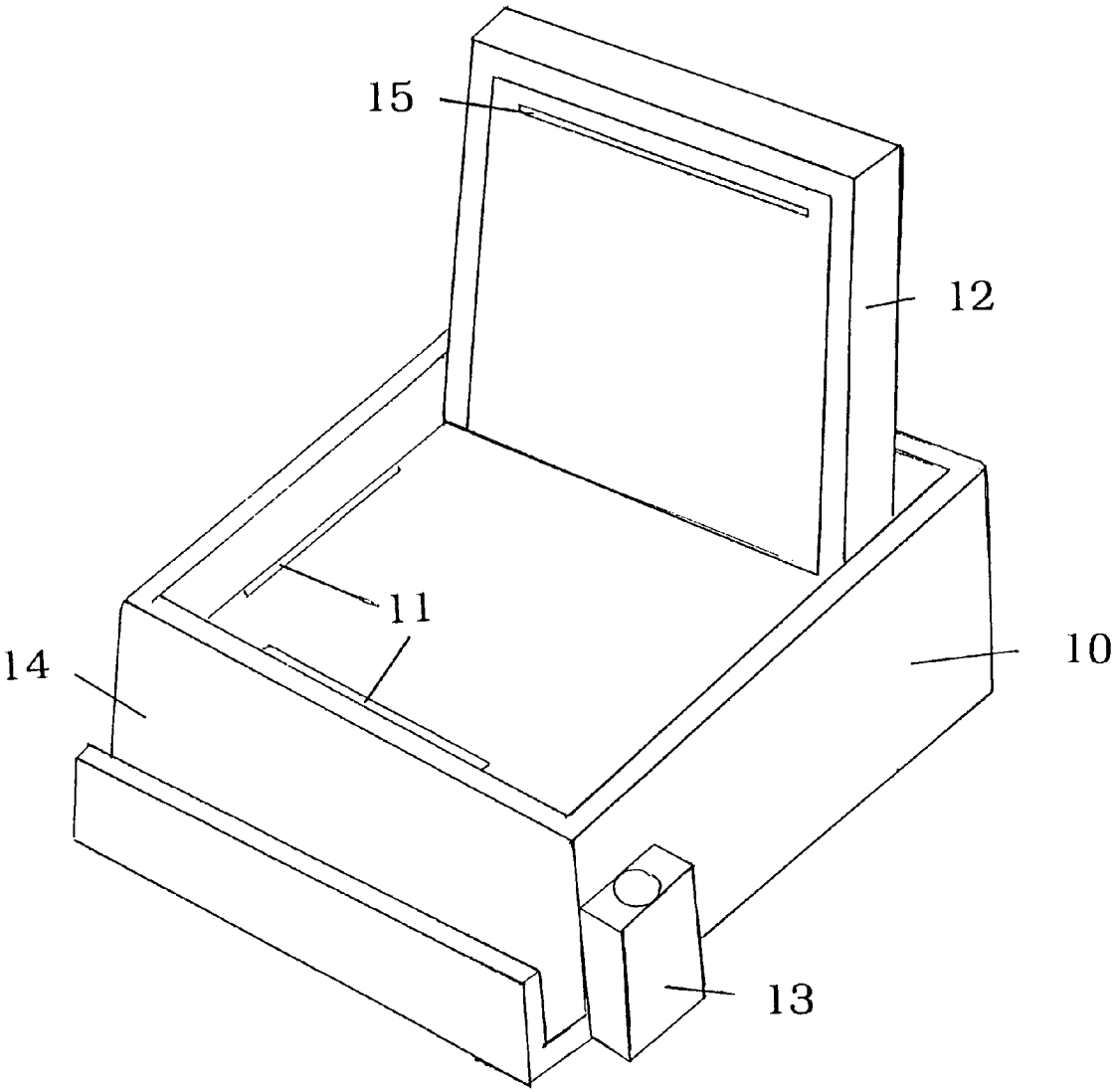
FIG. 1 shows a perspective view of an exemplary embodiment of the present invention.
Figure 3:
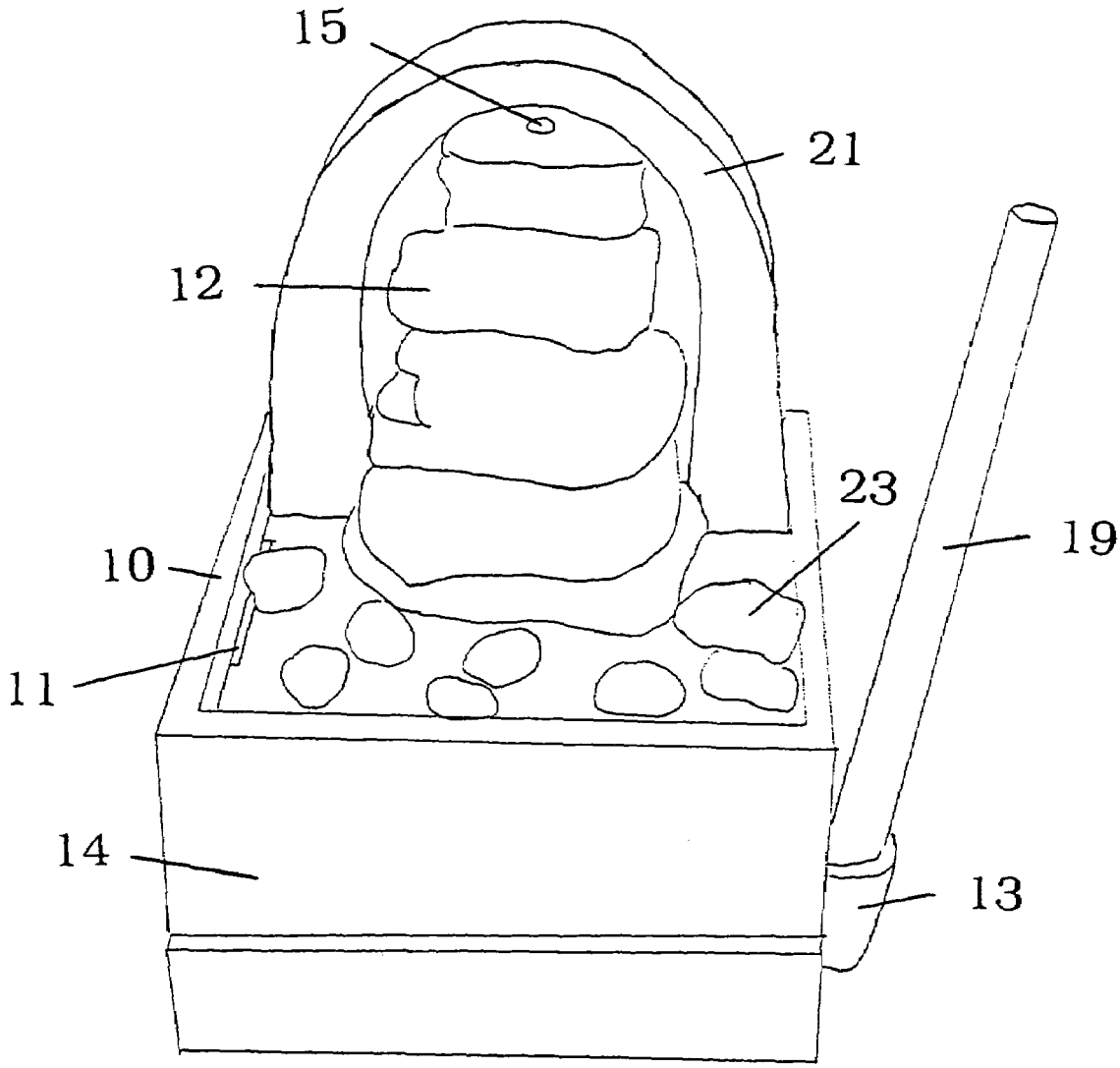
FIG. 3 shows an exemplary front view of a different aspect of the present invention.

As shown in FIGS. 1 and 3, the novelty waterfall of the present invention includes a lower structure 10 that at least forms a base for the waterfall and also supports an upper structure 12. Water flows out of a water outlet 15, flows down from the upper structure 12 to the lower structure 10, and will generally flow into one of a plurality of inlets 11 in a portion of the lower structure 10. The upper structure 12 and lower structure 10 can be formed of a poly-resin material, ceramic material, natural rocks, or any combination thereof. For example, the upper structure 10 and lower structure 12 may be separately molded in a plurality of parts using a poly-resin material. Thereafter the plurality of parts are combined together with, for example, an adhesive. Moreover, natural rocks 23 can be added to at least one of the upper structure 12 and lower structure 10 to improve aesthetics (See FIG. 3 (not shown in FIG. 1)). However, it would be within the spirit and scope of the present invention to use any material that is both aesthetically pleasing, strong, and water resistant for use in the upper structure 12 and lower structure 10.

Moreover, the upper structure 12, as shown in FIG. 1, has a substantially vertical face below outlet 15. This vertical face can include a roughened surface for the water to flow down, such that the water cascading over the roughened surface creates a waterfall-like effect. Alternatively, as shown in FIG. 3, the upper structure 12 can include one or more rock shaped structures for the water to flow across. In such an alternative aspect, the outlet 15 may be formed in one of the rock-shaped structures so that the water would flow over the rocks to the lower structure 10. With respect to the exemplary embodiment of FIG. 3, it is further contemplated that water outlet 15 can be positioned anywhere in the upper structure 12. For example, outlet 15 can be alternatively located in an aesthetic arch 21.

The novelty waterfall of the present invention can also include one or more additional features that will increase the usefulness of the novelty waterfall. It is contemplated that these additional features can include any one or more of a business card holder, pen holder, tape dispenser, stapler, hole punch, telephone, calculator, paper clip holder, note pad holder, post-it™ note holder, picture frame, and calendar. Of course, it would be within the scope and spirit of the present invention to use any known office product for use as the additional feature with the novelty waterfall of the present invention.

As shown in the exemplary FIGS. 1 and 3, the lower structure 10 is shown with the additional feature of a pen holder 13. The pen holder 13 includes a generally cylindrical hole that is shaped to receive and hold the pen in a manner that would facilitate retrieval of the pen by a user. The FIGS. 1 and 3 exemplary embodiments of the invention show that the pen holder 13 as a separate structure from lower structure 10 that is attached to the lower structure 10 and having a particular orientation and positioning. However, it would be within the scope and spirit of the present invention to have any positioning, orientation, or location of the pen holder 13 with respect to the waterfall in the lower structure 10 or upper structure 12.

As shown in the exemplary FIGS. 1 and 3, the lower structure 10 is also shown with the additional feature of a business card holder 14. The business card holder 14, as shown in FIG. 1, is formed by an additional structure extending from the lower structure 10. The business card holder 14 is structured and arranged such that a plurality of business cards can be held in an upright manner. Of course, it would be within the scope and spirit of the present invention to have any positioning, orientation, or location for the business card holder 14 with respect to the novelty waterfall.

Figure 2:
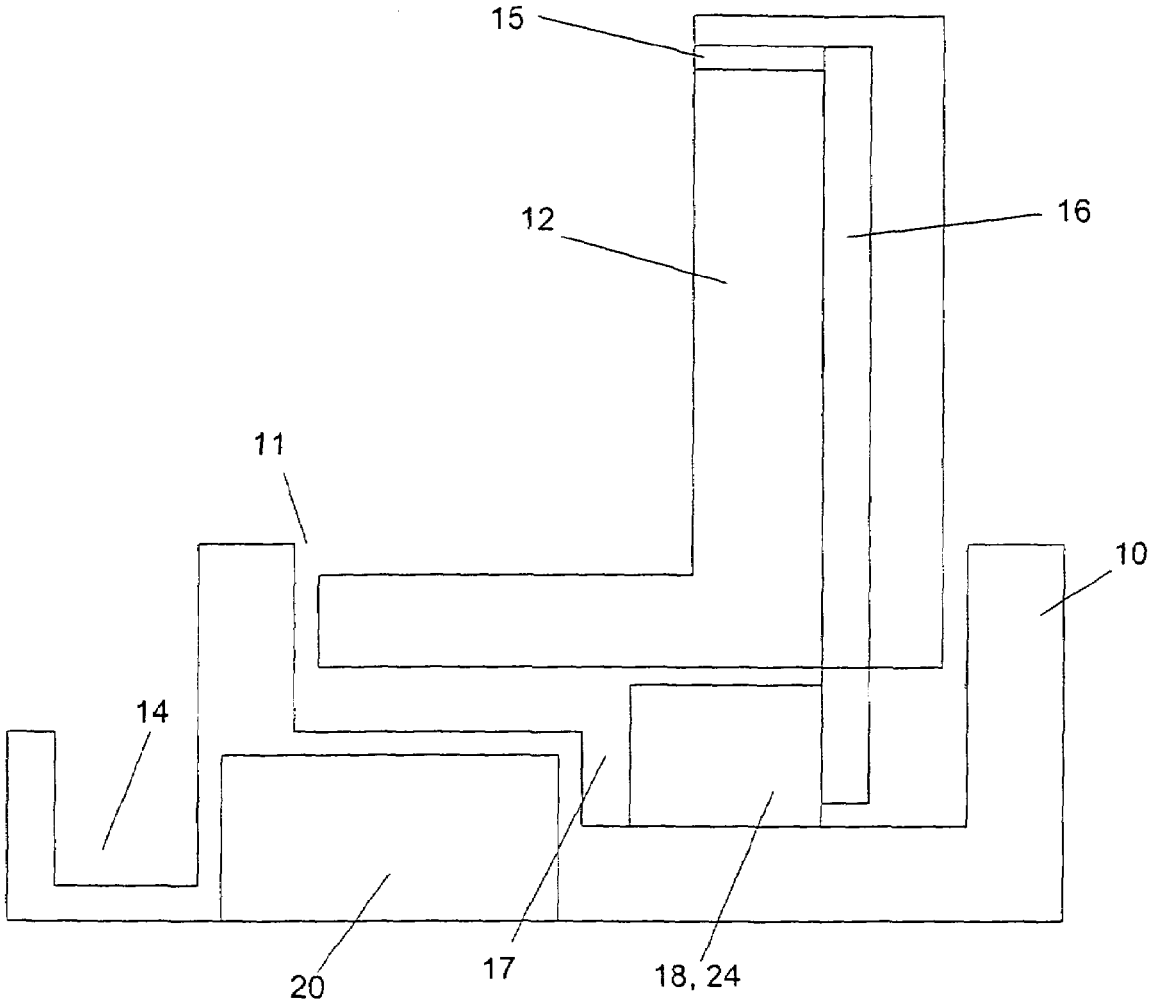
FIG. 2 shows an exemplary side view of the internal components of the FIG. 1 aspect of present invention.

Next, the internal structure of the novelty waterfall will be discussed in conjunction with FIG. 2. The water flowing out of outlet 15, flowing down upper structure 12, and into the inlet 11, will collect in a water collection area 17 within the lower structure 10. A pump 18 and associated pump motor 24 are located in the lower structure 10 and are in fluid communication with the water collection area 17. The pump 18 and pump motor 24, when operatively powered, force water that has collected in water collection area 17 into a conduit 16. The conduit 16 extends vertically from the lower structure 10 to upper structure 12. The conduit 16 directs water to the top of the upper structure 12 and is in fluid communication with outlet 15 to allow water to flow out of the conduit 16 and out of the outlet 15 to create a waterfall effect across and down the upper structure 12. FIG. 2 furthermore shows an electronics bay 20. The electronics bay 20 is configured to house at least one of a controller 20 or a power supply 22 (see also FIG. 4).

The novelty waterfall of the present invention includes an operative feature that causes the waterfall to operate when a user interacts with the waterfall. In particular, when a user uses, operates, or interacts with one or more of the additional features that can be included with the novelty waterfall, the novelty waterfall will operate. The operative feature that causes the waterfall to operate can be the only manner to operate the novelty waterfall or alternatively can be one of a plurality of ways to operate the waterfall.

In one aspect of the present invention, the operative feature that causes the novelty waterfall to operate is a switch and the additional feature is the pen holder 13. More specifically, the pen holder 13 includes a switch SW1 that is positioned in a bottom portion of the pen holder 13 that can sense the presence of a pen 19. In particular, the switch SW1 is positioned along the cylindrical opening that holds the pen in the pen holder 13. The switch SW1 includes an activating lever that extends into the cylindrical hole of pen holder 13. The lever is biased such that it maintains a first switch position and when the pen 19 is inserted into the hole, the pen moves the switch SW1 actuating lever to a second switch position. In other words, when a pen in positioned in the pen holder 13, the switch is closed. User interaction of removing the pen from the pen holder 13 will allow the actuating lever to move and open the switch and this user interaction will activate the waterfall. Of course, it should be apparent that the switch SW1 can alternatively be in the open position with the pen is in pen holder 13 and biased to a closed position when the pen 19 is removed from the pen holder 13 to operate the novelty waterfall. Moreover, it should be apparent that the above-noted operation can also be based on a user placing the pen in the pen holder 12 and such is within the spirit and scope of the present invention.

The novelty waterfall also includes a controller that controls the operation of the novelty waterfall based on the user interaction. For example, as shown in FIG. 4, the controller can be a control circuit 20 and the operation of the novelty waterfall is controlled with the control circuit 20 based on sensing user interaction with the novelty waterfall.

Additionally, the control circuit 20 can include a master switch SW2 that controls the overall operation of the novelty waterfall. More specifically, the control circuit 20 will operate based on the master switch SW2 and based on an input from the operative feature that is in this aspect of the present invention a sensor switch SW1.

Figure 4:
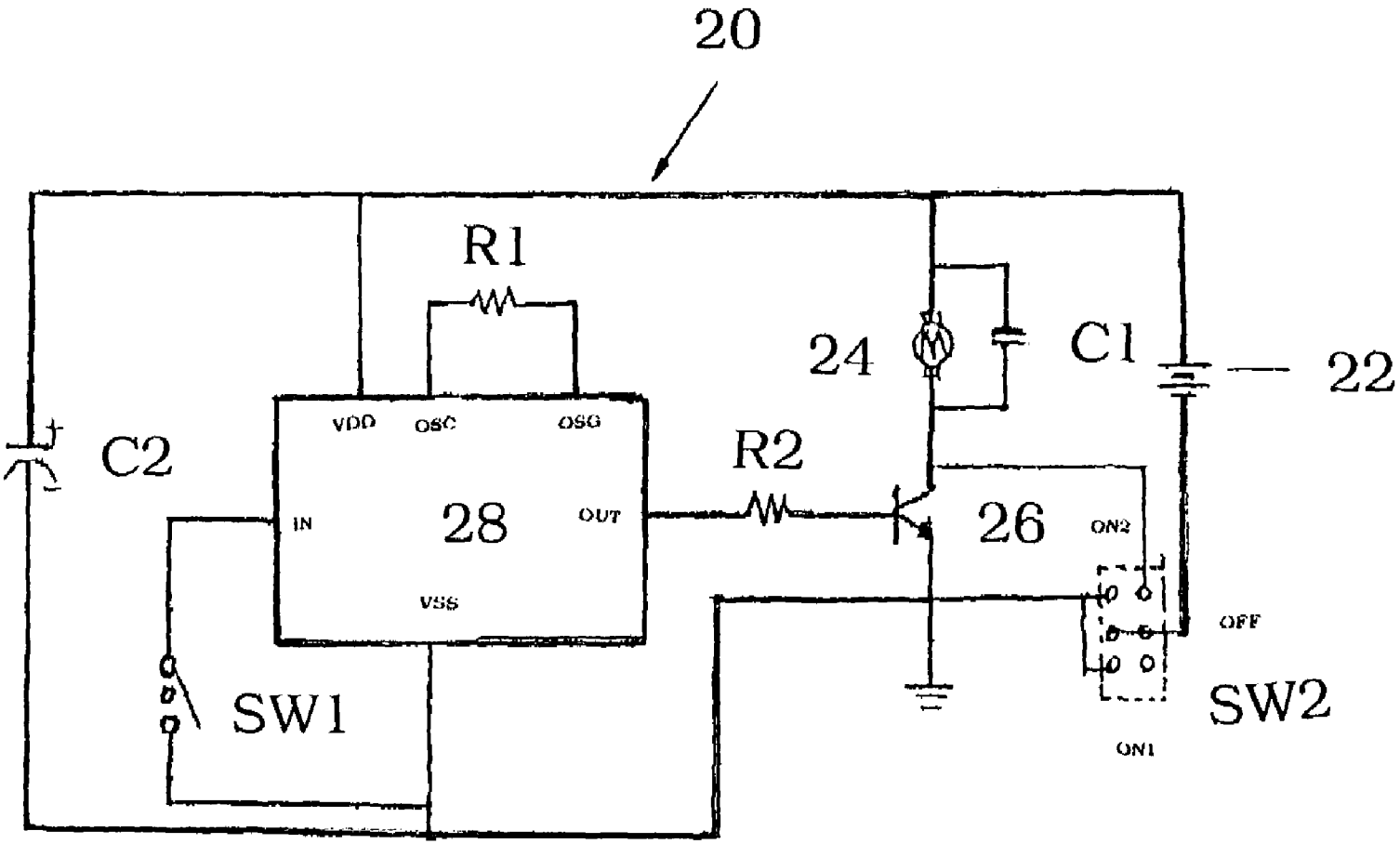
FIG. 4 shows an exemplary circuit diagram according to an embodiment of the present invention.

In one aspect of the invention, the master control switch SW2 can control the mode of the novelty waterfall to be either completely "off" when the master switch SW2 is in position two (OFF—center position of switch SW2 as shown in FIG. 4); "on" to sense user interaction, when the master switch SW2 is in position one (ON1—lower position of switch SW2); or continuously "on" when the master switch SW2 is in position three (ON2—upper position of switch SW2). The continuously "on" position of the master switch SW2 allowing the novelty waterfall to operate continuously regardless of the user interaction.

In a particular aspect of the invention shown in FIG. 4, the control circuit 20 is shown with a switch SW1 that senses user interaction and the master switch SW2. The control circuit 20 can include at least a transistor 26, an integrated circuit 28, a first resistor R1, a second resistor R2, a first capacitor C1, a second capacitor C2, a power supply 22, and pump motor 24.

The control circuit 20 and the novelty waterfall are operatively powered by the power supply 22. The power supply can, in one aspect, be two 1.5 volt batteries in series. However, it should be apparent that any number of batteries, a power supply such as 120 volt AC power supply used in conjunction with a transformer and an AC to DC conversion circuit, or any other power source would be within the spirit and scope of the present invention.

The pump 18 can include an integral pump motor 24 or may alternatively be separate pump 18 and pump motor 24 components that are functionally connected in order to pump water when power is provided to the combination. As shown in FIG. 4, the pump motor 24 is connected to the voltage supply 22 and is also connected to the transistor 26. The transistor 26 is also connected through the master switch SW2 to the power supply 22 and ground. When the transistor 26 is powered such that the transistor is switched to allow current to flow and switch SW2 is in the ON1 position, the circuit is completed to allow power from power supply 22 to flow through motor 24 and therefore pump water through the novelty waterfall. Additionally, the pump motor 24 can include the capacitor C1 across the pump motor 24 power connections to at least smooth that power supplied to the pump motor 24.

In the particular aspect of the present invention shown in FIG. 4, the control circuit 20 can be implemented as an integrated circuit 28. The integrated circuit 28 is powered with the power supply 22 with connections to a voltage drain drain VDD and a voltage for substrate and sources VSS. Moreover, the first resistor R1 can be connected across the OSC and OSG connections of the integrated circuit to provide an input to the integrated circuit 28 oscillator.

An output OUT of the integrated circuit 28 can be connected to the second resistor R2 and the second resistor R2 can be connected to the base of the transistor 26 to control the operation of the transistor 26. More specifically, a high output from the output OUT of the integrated circuit 28 will power the transistor 26 through resistor R1 and complete the circuit for motor 24 operation as noted above.

The control circuit 20 can include the second capacitor C2 across the VDD and VSS connections to provide, for example only, smoothing of the voltage input to the integrated circuit 28. The control circuit 20 also includes an input IN. The input IN is connected to sensor switch SW1. The switch SW1 is in turn connected to the power source 22 through switch SW2. When switch SW1 is closed, the IN input of integrated circuit 28 will register the transitional input in input IN and initiate operation of the novelty waterfall. Of course, it would be within the scope and spirit of the present invention to register a transitional input based on switch SW1 opening.

Figure 5:
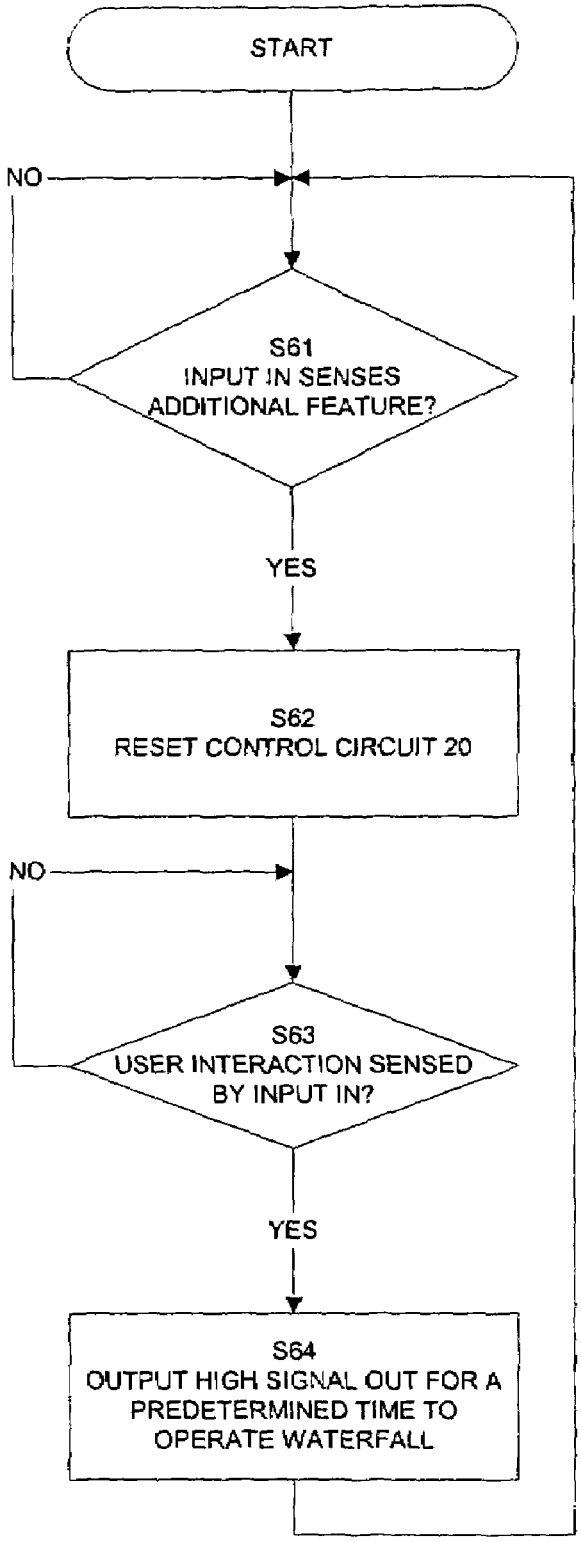
FIG. 5 shows exemplary logic flow of the present invention.

Next, the integrated circuit 28 operation will be discussed in conjunction with FIG. 5. As shown in FIG. 5, in step S61 the integrated circuit will monitor input IN to determine when there is a signal (high or low) indicative of the presence of the additional feature. In the exemplary aspect of the invention, the additional feature being a pen 19 in the pen holder 13. When integrated circuit 28 registers a input at IN, the integrated circuit 28 will reset the integrated circuit 28 in step S62 and the logic will flow to step S63. In step S63, the integrated circuit 28 will monitor input IN for a transitional value. When a user interacts with the additional feature, the operative feature will cause a transitional value to be input to IN. In the exemplary aspect of the present invention, the user removing the pen 19 from the pen holder 13 will open switch SW1 to create the transitional value. In step S64, the integrated circuit 28 will output a high signal from the output OUT. This output will cause transistor 26 to complete the circuit for pump motor 24 to operate. Step S64 will output the high signal from OUT for a predetermined time. In this regard, the novelty waterfall can be powered with the control circuit 20 to operate for a limited time after user interaction is sensed. In one particular aspect, the integrated circuit 28 will output the high signal for 60 seconds. However, it is contemplated that any length of operation would be within the scope and spirit of the present invention. After outputting the OUT signal, the logic will return to step S61 in order to again operate as noted above.

In a particular aspect of the present invention, the integrated circuit 28 can be implemented as a model no. MC3149-313. Moreover, the first resistor R1 can be 82KΩ, resistor R2 can be 100 Ω, capacitor C1 can be 10,000 F, capacitor C2 can be 1000 μF, transistor 26 can be a model 8050D transistor, and the switch SW2 can be implemented as a double-pole double-throw switch. However, it is with the spirit and scope of the present invention to use any circuit values that will allow the integrated circuit 28 to provide the desired timer operations. Moreover, any integrated circuit providing timing functions, such as the model 555 timer, is considered within the scope and spirit of the present invention.

In another aspect of the present invention, the master switch SW2 is single-pole single-throw switch. In this regard, the control circuit 20 would control the mode of the novelty waterfall to be either completely "off" when the master switch SW2 is in position two (OFF—center position of switch SW2 as shown in FIG. 4) and "on" to sense user interaction, when the master switch SW2 is in position one (ON1—lower position of switch SW2). More specifically, when the master switch SW2 is in the "off" position, the novelty waterfall will not be powered. However, when the master switch SW2 is in the "on" position, the novelty waterfall will be powered when user interaction is sensed as noted above with respect to FIG. 5. However, in this aspect of the invention there would not be a ON2 position for switch SW2 and there would not be the associated connections for the ON2 switch position.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A novelty waterfall comprising:

at least one water flow surface;

a pump;

a sensor that detects a change of presence of an office product; and a controller that is structured and arranged to operate the pump at least when the sensor detects the change of presence of the office product.

2. The novelty waterfall according to claim 1 wherein the sensor is a first switch and the first switch is one of opened or closed to detect the change of presence of the office product.

3. The novelty waterfall according to claim 2 further comprising:

a pen holder, wherein the first switch is in the pen holder and the change of presence of the office product is detected when the first switch is one of opened or closed when a user one of removes or places the office product comprising a pen in the pen holder.

4. The novelty waterfall according to claim 2 further comprising:

a water outlet;

a conduit that is configured to allow water to flow to the top of the waterfall and out of the water outlet;

a motor associated with the pump that pumps water through the conduit; and a water inlet that allows water to enter from the at least one surface to provide water to the pump.

5. The novelty waterfall according to claim 3 further comprising:

a second switch, wherein when the second switch is in a first position, the waterfall operates when the sensor detects the change of presence of the office product.

6. The novelty waterfall according to claim 5 wherein when the second switch is in a second position the waterfall does not operate.

7. The novelty waterfall according to claim 6 wherein the second switch comprises a third position and when the second switch is in the third position, the waterfall operates continuously.

8. The novelty waterfall according to claim 4 wherein the controller is structured and arranged to connect the pump and motor to a power source.

9. The novelty waterfall according to claim 1 wherein the controller causes water to flow across the at least one surface for a predetermined time after the sensor detects the change of presence.

10. The novelty waterfall according to claim 1 wherein the controller comprises an electrical circuit.

11. The novelty waterfall according to claim 1 further comprising:

a business card holder.

12. A novelty waterfall comprising:

at least one water flow surface;

a water outlet;

a conduit configured so that water flows up to and out of the water outlet;

a pump and motor that pumps water through the conduit;

a water inlet that allows water to enter from the at least one surface to provide water to the pump;

a controller structured and arranged to operate the pump and motor when there is user interaction; and a pen holder in which a first switch is located in the pen holder and user interaction is sensed when the first switch is one of opened or closed when a user one of removes or places a pen in the pen holder.

13. The novelty waterfall according to claim 12 further comprising:

a second switch in which when the second switch is in a first position, the waterfall operates when the sensor senses user interaction, and when the second switch is in a second position the waterfall does not operate.

14. The novelty waterfall according to claim 13 wherein the second switch comprises a third position and when the second switch is in the third position, the waterfall operates continuously.

15. The novelty waterfall according to claim 12 wherein the controller is structured and arranged to connect the pump and motor to a power source.

16. The novelty waterfall according to claim 12 wherein the controller causes water to flow across the at least one surface for a predetermined time after the sensor senses user interaction.

17. The novelty waterfall according to claim 12 wherein the controller comprises an electrical circuit.

18. The novelty waterfall according to claim 12 further comprising:

a business card holder.

19. A method of operating a novelty waterfall comprising:

one of removing an office product from or placing an office product into a receptacle coupled to the novelty waterfall; and operating the novelty waterfall for a predetermined time in response to one of removing or placing the office product.

20. The method according to claim 19 further comprising:

sensing when a first switch is one of opened or closed when a user removes or places the office product into the receptacle, wherein the office product is a pen and the receptacle is a pen holder.

21. A novelty waterfall operating according to the method of claim 19.

22. The novelty waterfall according to claim 1 wherein the at least one water flow surface, the pump, the sensor that detects a change of presence of an office product, and the controller that is structured and arranged to operate the pump at least when the sensor detects the change of presence of the office product together comprise a unit.

* * * * *